US008480603B2

(12) United States Patent
Chen

(10) Patent No.: US 8,480,603 B2
(45) Date of Patent: Jul. 9, 2013

(54) DRIVING MECHANISM FOR A MASSAGE CHAIR

(75) Inventor: Yuan-Chuen Chen, Fu-Hsing Hsiang (TW)

(73) Assignee: Hsin Hao Health Materials Co., Ltd., Chang-Hua Hsien (TW)

( * ) Notice: Subject to any disclaimer, the term of this patent is extended or adjusted under 35 U.S.C. 154(b) by 273 days.

(21) Appl. No.: 13/082,401

(22) Filed: Apr. 8, 2011

(65) Prior Publication Data

US 2012/0259256 A1 Oct. 11, 2012

(51) Int. Cl.
*A61H 7/00* (2006.01)
*A61H 19/00* (2006.01)

(52) U.S. Cl.
USPC ..... 601/98; 601/134

(58) Field of Classification Search
USPC ..... 601/84, 86, 90, 97, 98, 99, 101, 134
See application file for complete search history.

(56) References Cited

U.S. PATENT DOCUMENTS

| | | | | |
|---|---|---|---|---|
| 4,718,408 | A * | 1/1988 | Barreiro | 601/99 |
| 5,184,607 | A * | 2/1993 | Hwang | 601/102 |
| 5,462,516 | A * | 10/1995 | Anderson | 601/99 |
| 6,283,928 | B1 * | 9/2001 | Wang | 601/99 |
| 6,364,850 | B1 * | 4/2002 | Wang | 601/98 |
| 6,551,259 | B1 * | 4/2003 | Wu | 601/99 |
| 8,202,235 | B2 * | 6/2012 | Huang | 601/103 |
| 2009/0270777 | A1 * | 10/2009 | Wu et al. | 601/87 |

* cited by examiner

*Primary Examiner* — Kristen Matter

(57) ABSTRACT

A driving mechanism for a massage chair, the massage chair has a primary frame and a massaging set, the primary frame having a vertical bidirectional screw rod, a passive member connected to the massaging set jacketed onto the bidirectional screw rod. The massaging set utilizes the driving motor to provide synchronized massage movements and vertical movements, and the massaging set engages with the passive member and the bidirectional screw rod such that when the massaging set reaches to the very top end or the very bottom end the bidirectional screw rod it directly changes its direction of movement without any sensor, which can reduce and simplify structural costs.

4 Claims, 7 Drawing Sheets

DRIVING MECHANISM FOR A MASSAGE CHAIR

BACKGROUND OF THE INVENTION

1. Field of the Invention

The present invention relates to an improved driving mechanism for a massage chair, and more particularly to a massage chair having a bidirectional screw rod for vertical movement.

2. Description of the Related Prior Art

Currently, modern living is leading to high stress and tension, and therefore we often feel exhausted, tired, and suffer from muscle fatigue. Naturally, massages have become one of the more popular methods for recovering. For a typical massage chair 50, please refer to FIG. 7. A massaging set 51 is attached onto a sliding track 52; a driving motor 53 and a screw 531 are used for driving the massaging set 51 along the sliding track 52. Two sensors 54 are respectively installed at upper end and lower ends of the screw 531. When the driving motor 53 is turned on, the massaging set 51 moves up or down along the screw 531 during the rotation of the screw 531 until it actives the sensor 54, and then the driving motor 53 receives a signal from the sensor 54 to rotate in an opposite rotation direction to move the massaging set 51 in an opposite direction.

The above-mentioned structure has the following drawbacks: the massaging set 51 is attached to the driving motor 53 coupled to the screw 531 to move vertically; the sensor 54 signals the driving motor 53 to change to an opposite direction, and the massaging set 51 requires another driving member to provide additional massaging movements. Therefore, this prior art structure has higher manufacturing costs, and the driving motor 53 can wear out more easily due to repeated counter clock-wise rotation.

Therefore, it is desirable to provide a driving mechanism for a massage chair to mitigate and/or obviate the aforementioned problems.

SUMMARY OF THE INVENTION

An objective of the present invention is to provide a driving mechanism for a massage chair, which has a bidirectional screw rod for vertical movements.

In order to achieve the above-mentioned objective, a massage chair comprises a primary frame and a massaging set. The primary frame has a vertical bidirectional screw rod, and a passive member is connected to the massaging set and jacketed onto the bidirectional screw rod. The massaging set comprises an integration space on one side for accepting a driving motor. An active end of the driving motor has an engaging gear inserted through the integration space; the bidirectional screw rod is vertically disposed on the primary frame and is adjacent to the driving motor. The bidirectional screw rod has a first sliding slot and a second sliding slot, each having a stroke opposite the other, and both upper and lower ends of each stroke of the first and second sliding slots respectively forming a connecting slot connecting to each other. A passive member is jacketed onto the bidirectional screw rod and provides an engaging member that engages with slots of the bidirectional screw rod such that the passive member is capable of moving along the bidirectional screw rod. The passive member is disposed in the integration space of the massaging set. A plurality of driving teeth and a plurality of engaging teeth are respectively formed on an upper and lower end of the passive member, and the engaging teeth engage with the driving motor via the engaging gear in the integration space.

With the above-mentioned structure, the following benefits can be obtained: the massaging set utilizes the driving motor to provide symmetrical massage movements and vertical movements, and the massaging set engages with the passive member and the bidirectional screw rod such that when the massaging set reaches the top end or the bottom end the bidirectional screw rod directly changes the direction of the movement without any sensor, which can reduce and simplify structure costs.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
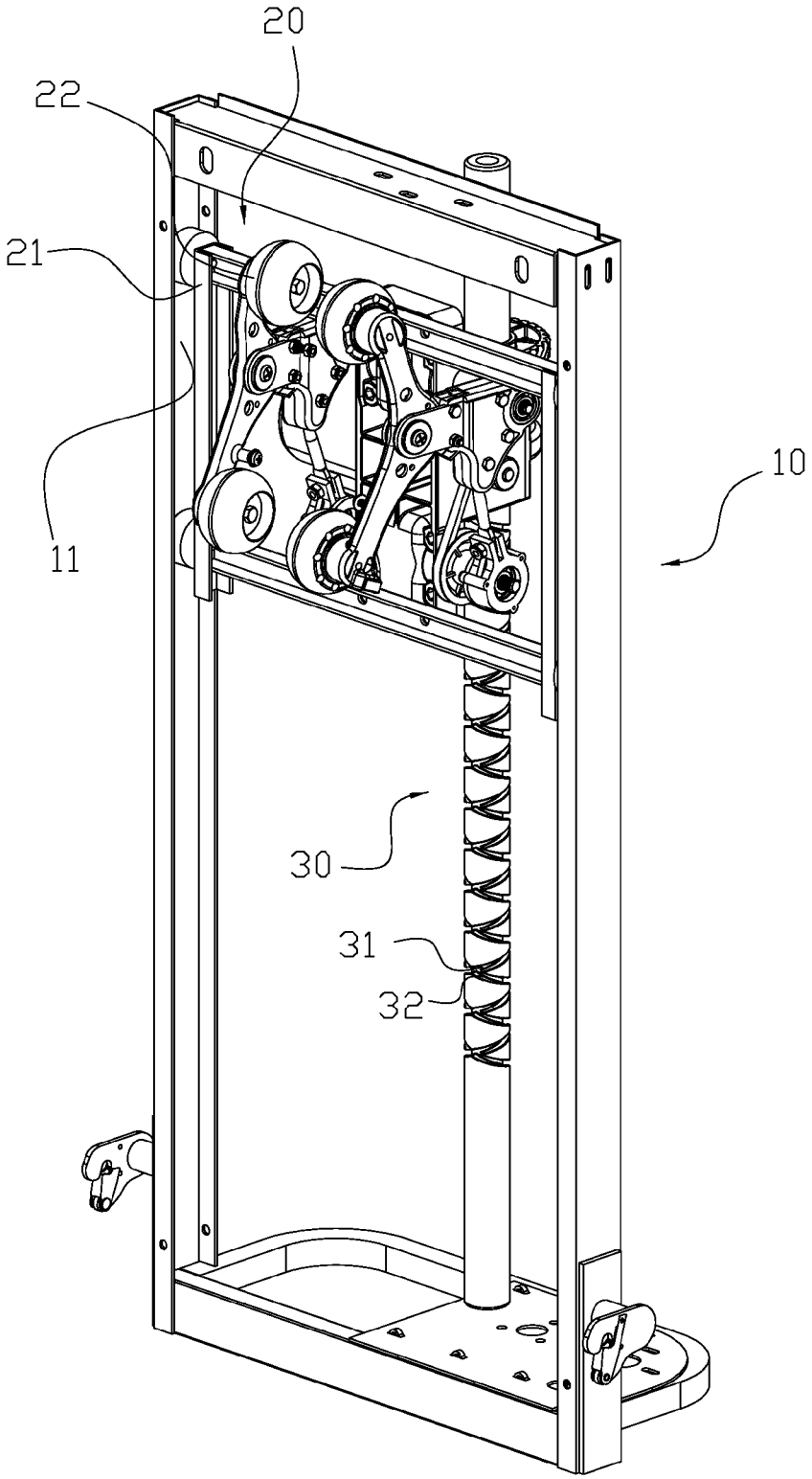
FIG. 1 is a perspective view of an embodiment of the present invention.
Figure 2:
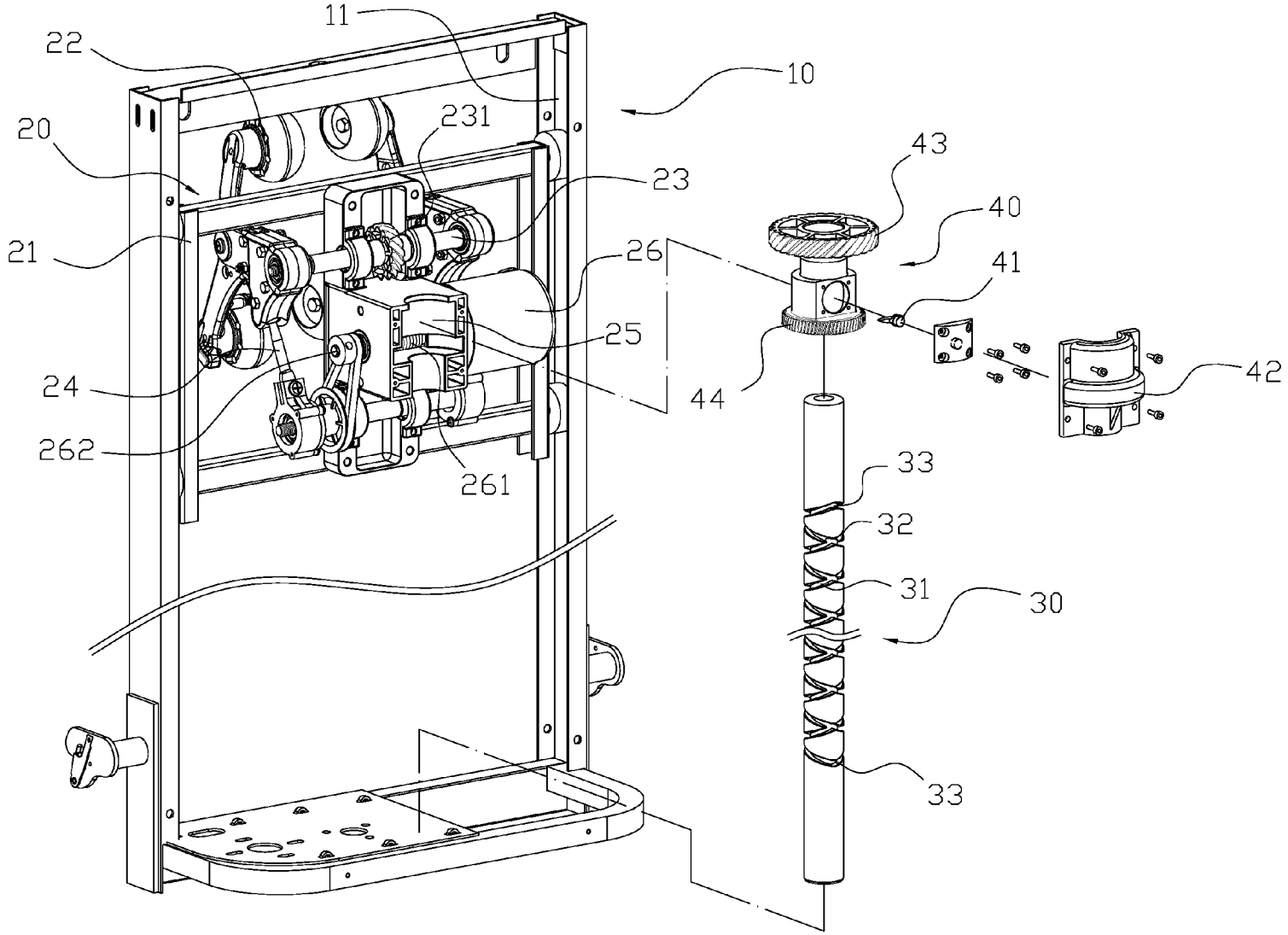
FIG. 2 is an exploded view of an embodiment of the present invention.
Figure 3:
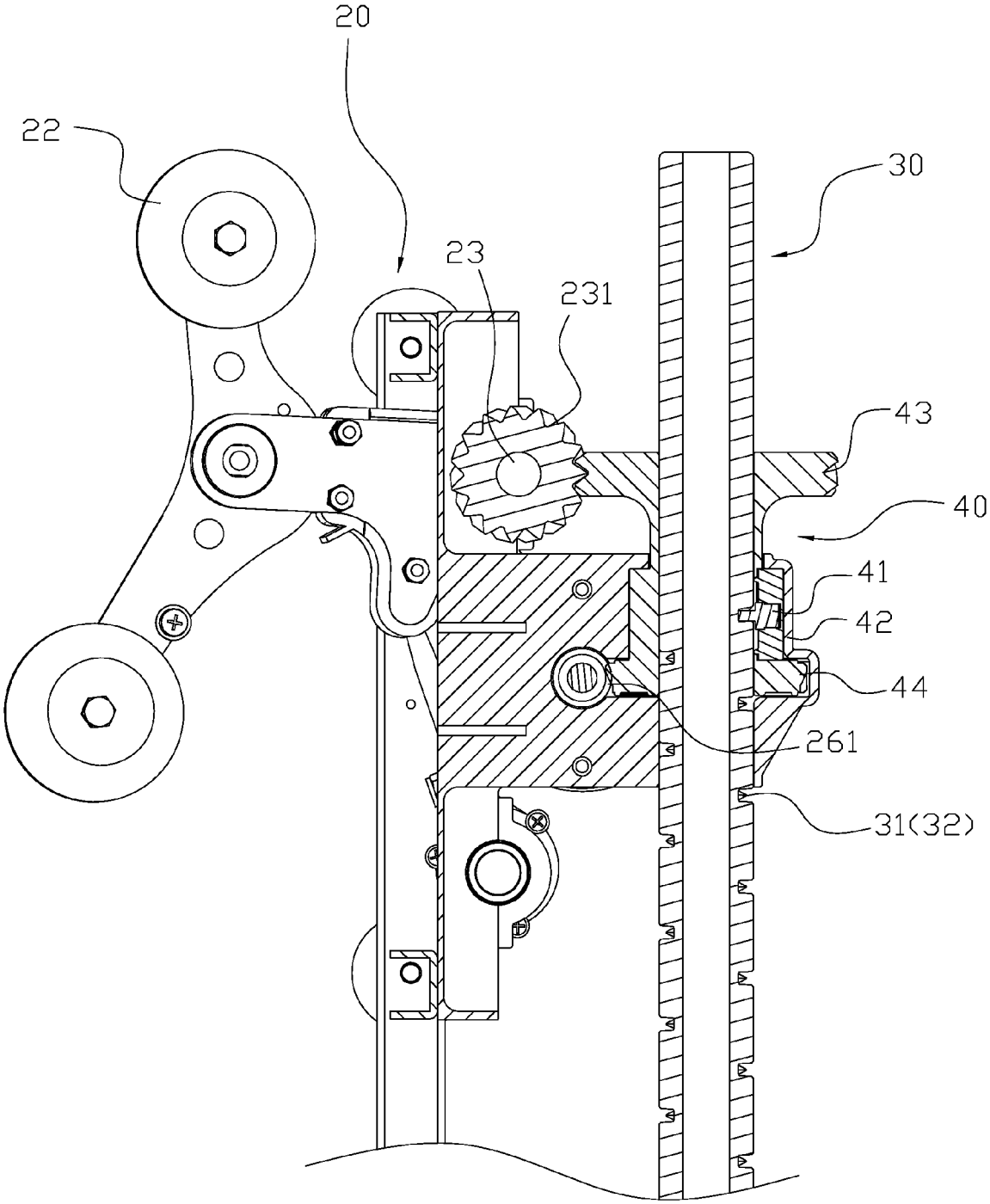
FIG. 3 is a cross-sectional view of an embodiment of the present invention.

First please refer to FIGS. 1, 2 and 3. A driving mechanism for a massage chair is provided, in which the massage chair comprises a primary frame 10 and a massaging set 20. The primary frame 10 has a vertical bidirectional screw rod 30 and a passive member 40 connected to the massaging set 20 jacketed onto the bidirectional screw rod 30. The primary frame 10 further comprises two sliding tracks 11, one on each side, and two corresponding sides of the massaging set 20 engage with the sliding tracks 11 of the primary frame 10 such that the massaging set 20 is limited to the primary frame 10 and capable of sliding movements. The massaging set 20 further comprises a pair of massaging arms 22; the two massaging arms 22 are symmetrically driven by a first driving shaft 23 and two swing arms 24, and the first driving shaft 23 is coupled to a transmission gear 231. The massaging set 20 comprises an integration space 25 on one side for accepting a driving motor 26, and an active end of the driving motor 26 has an engaging gear 261 that is inserted through the integration space 25. The driving motor 26 thus passes through the integration space 25 to engage with a second driving shaft 262 connected to the swing arm 24. The bidirectional screw rod 30 is vertically disposed on the primary frame 10 adjacent to the driving motor 26. The bidirectional screw rod 10 has a first sliding slot 31 and a second sliding slot 32, each having a stroke opposite the other, and both upper and lower ends of each stroke of the first and second sliding slots 31, 32 respectively form a connecting slot 33 connecting to each other. The passive member 40 is jacketed onto the bidirectional screw rod 30 and provides an engaging member 41 that engages with slots of the bidirectional screw rod 30 such that the passive member 41 is capable of moving along the bidirectional screw rod 30. The passive member 40 is disposed in the integration space 25 of the massaging set 20 and surrounded by a casing 42; a plurality of driving teeth 43 and a plurality of engaging teeth 44 are respectively formed on an upper and lower end of the passive member 40.

Figure 4:
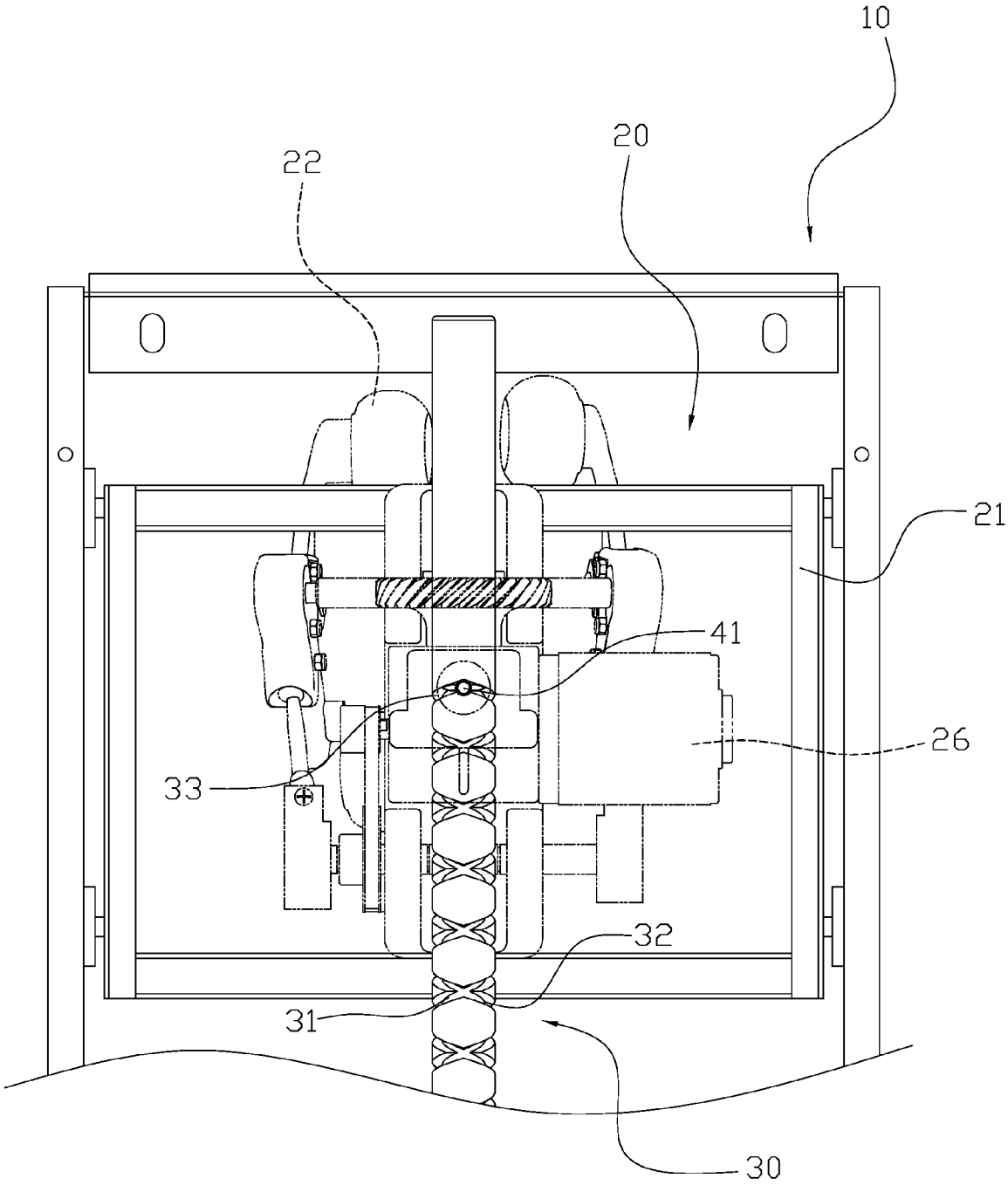
FIG. 4 is a back view of an embodiment of the present invention.

For assembly, please refer to FIGS. 2, 3 and 4. The massaging set 20 is installed onto the primary frame 10 and utilizes the sliding base 21 to slide along the sliding track 11. The bidirectional screw rod 30 is jacketed by the passive member 40, and the engaging teeth 44 of the passive member 40 are disposed in the integration space 25 of the massaging set 20 and engage with the engaging gear 261 of the driving motor 26. Furthermore, the driving teeth 43 of the passive member 40 are disposed outside of the integration space 25 and engage with the transmission gear 231 of the first driving shaft 23. When the engaging teeth 44 of the passive member 40 are driven by the engaging gear 261 of the driving motor 26, the driving teeth 43 engage with the first driving shaft 33, the swing arm 24 is driven by the second driving shaft 262 of the driving motor 26 such that the massaging arms 22 of the massaging set 20 are driven by the first driving shaft 23 and the swing arms 24.

For actual operations, please refer to FIGS. 3 and 4. When a user turns the power on to start the driving motor 26, the engaging teeth 44 of the passive member 40 are driven by the engaging gear 261 to rotate, the driving teeth 43 of the passive member 40 drive the transmission gear 231 of the first driving shaft 23, and the second driving shaft 262 of the driving motor 26 also drives the swing arm 24 such that the massaging arms 22 are driven by the first driving shaft 23 and the swing arm 24. When the passive member 40 is rotated by the driving motor 26 to drive the massaging arms 22, the passive member 40 moves along the sliding slots 31, 32 on the bidirectional screw rod 30 by way of the engaging member 41. Furthermore, the massaging set 20 has the sliding base 21 positioned onto the sliding track 11 of the primary frame 10 such that the passive member 40 controls the vertical movements of the massaging set 20. Therefore, when the driving motor 26 is turned on, the massaging arms 22 and the sliding base 21 have synchronized movements.

Figure 5:
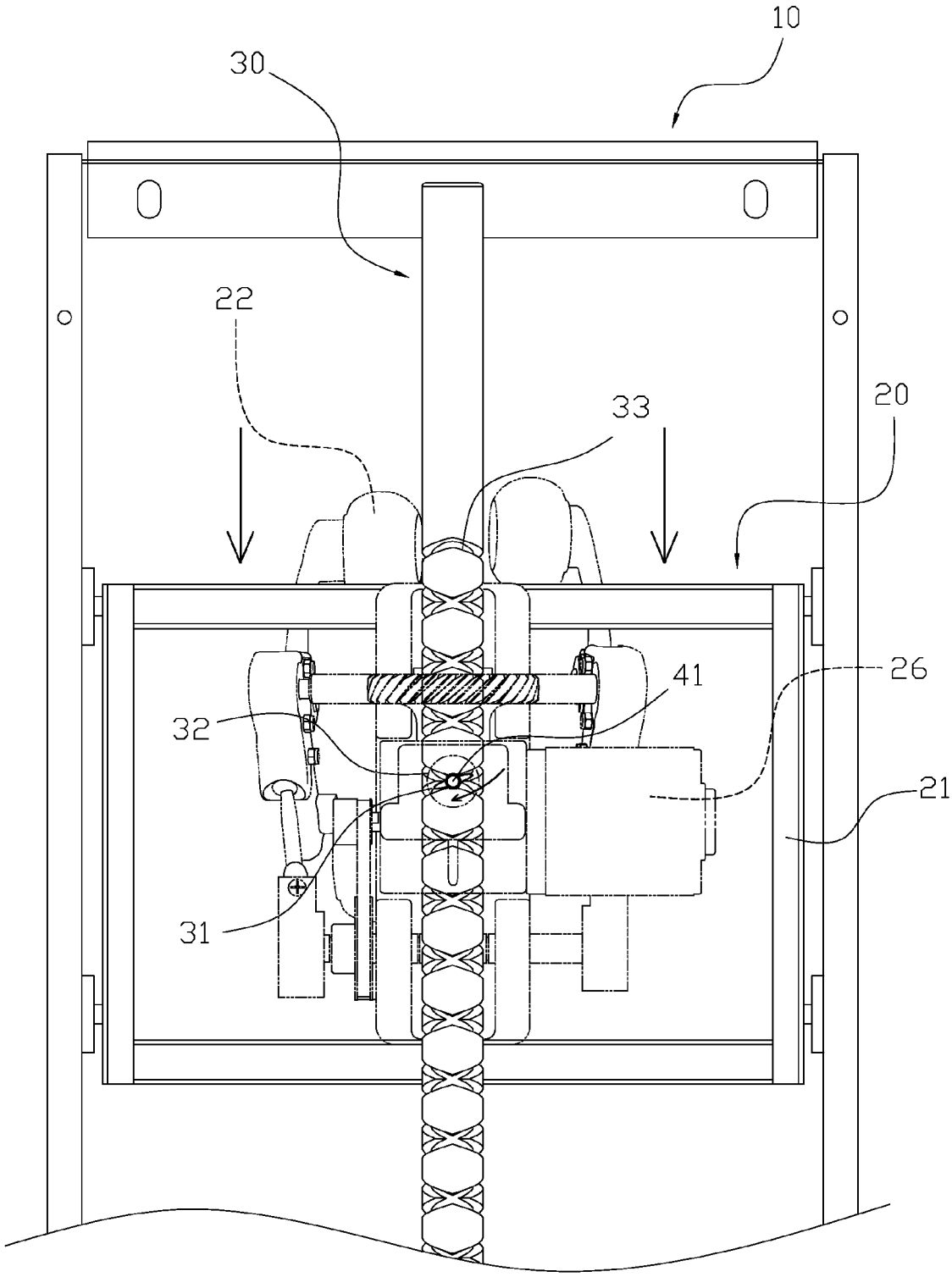
FIG. 5 illustrates lowering movement of an embodiment of the present invention.
Figure 6:
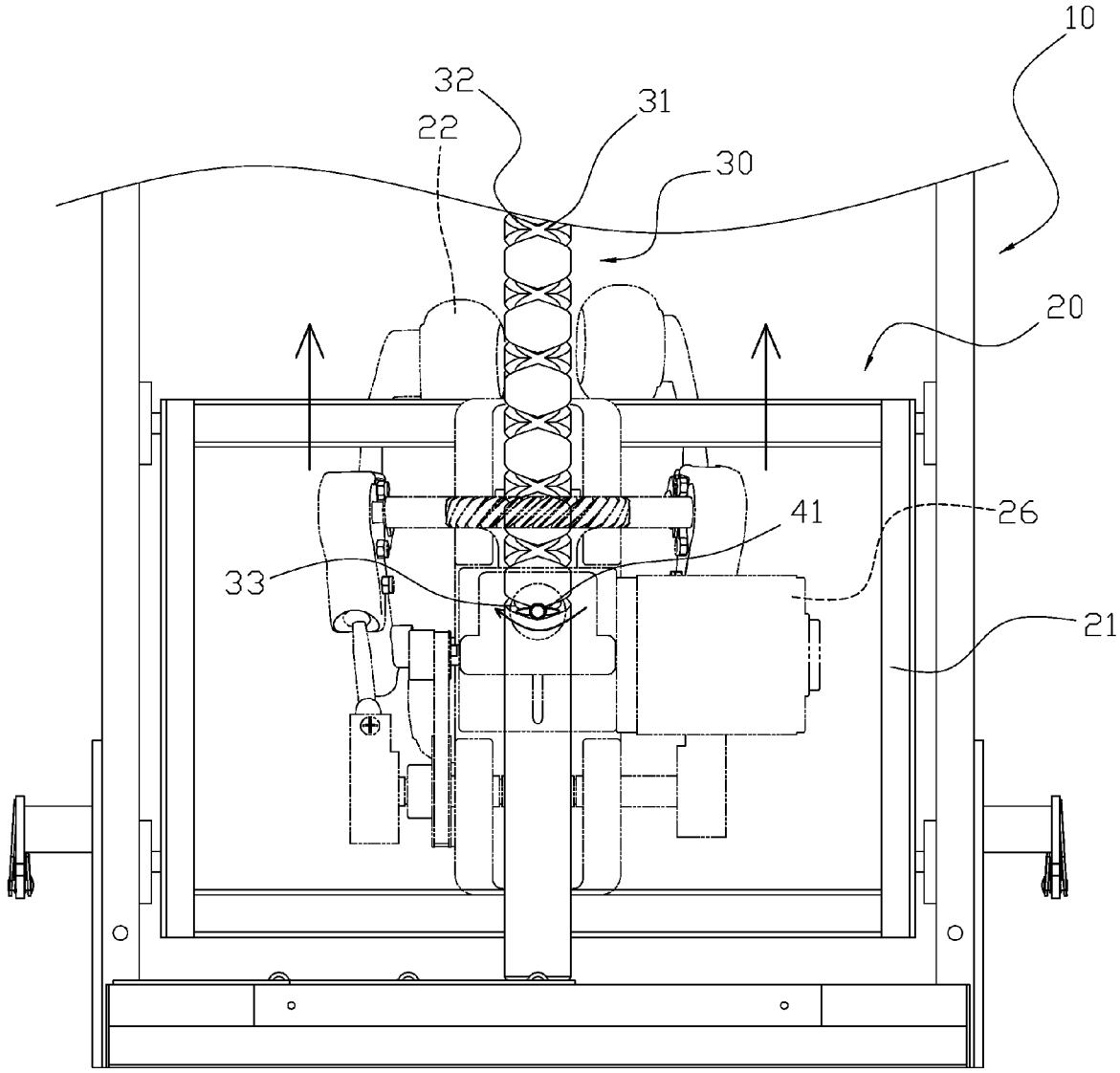
FIG. 6 illustrates climbing movement of an embodiment of the present invention.
Figure 7:
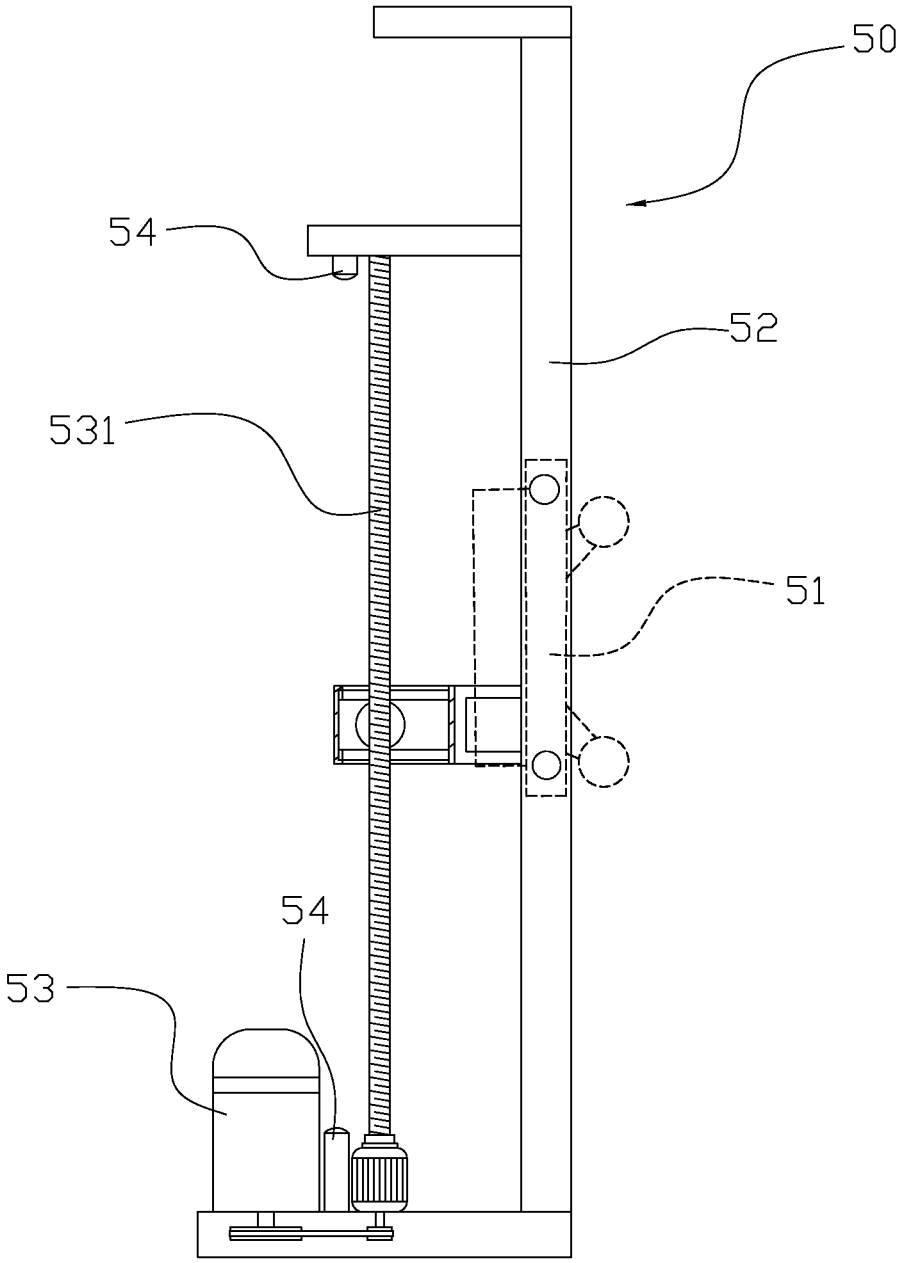
FIG. 7 PRIOR ART
FIG. 7 is a schematic drawing of a prior art structure.

The bidirectional screw rod 30 has the first sliding slot 31 and the second sliding slot 32 respectively having opposite strokes. When the passive member 40 is driven by the driving motor 26 to rotate around the bidirectional screw rod 30, the passive member 40 utilizes the engaging member 41 to slide down along the first sliding slot 31, as shown in FIG. 5, and drive the massaging set 20 to slide down along the primary frame 10. After the engaging member 41 of the passive member 40 moves to the end of the first sliding slot 31 of the bidirectional screw rod 30, it continuously moves into the connecting slot 33 to enter into the second sliding slot 32, as shown in FIG. 6. Meanwhile, while the driving motor 26 is operating, the engaging member 41 of the passive member 40 slides along the second sliding slot 32 to move the massaging set 20 upwardly, until the engaging member 41 reaches the end of the second sliding slot 32. The connecting slot 33 and the first sliding slot 31 are connected to each other, as shown in FIG. 4, and the passive member 40 with the massaging set 20 can therefore again move downwardly along the first sliding slot 31.

With the above-mentioned structure, the following benefits can be obtained: the massaging set 20 utilizes the driving motor 26 to provide synchronized massage movements and vertical movements, and the massaging set 20 engages with the passive member 40 and the bidirectional screw rod 30 such that when the massaging set 20 reaches to the very top end or the very bottom end the bidirectional screw rod 30 it directly changes its direction of movement without any sensor, which can reduce and simplify structural costs.

Although the present invention has been explained in relation to its preferred embodiment, it is to be understood that many other possible modifications and variations can be made without departing from the spirit and scope of the invention as hereinafter claimed.

What is claimed is:

1. A driving mechanism for a massage chair, the massage chair comprising a primary frame and a massaging set, the primary frame having a vertical bidirectional screw rod, a passive member connected to the massaging set jacketed onto the bidirectional screw rod; the driving mechanism characterized in that:

the massaging set comprises an integration space on a side for accepting a driving motor, an active end of the driving motor having an engaging gear inserted through the integration space; the bidirectional screw rod vertically disposed on the primary frame and adjacent to the driving motor, the bidirectional screw rod having a first sliding slot and a second sliding slot, each having a stroke opposite the other, and both upper and lower ends of each stroke of the first and second sliding slots respectively forming a connecting slot connecting to each other; a passive member jacketed onto the bidirectional screw rod and providing an engaging member that engages with the first and second sliding slots of the bidirectional screw rod such that the passive member is capable of moving along the bidirectional screw rod, and the passive member is disposed in the integration space of the massaging set, a plurality of driving teeth and a plurality of engaging teeth respectively formed on an upper and lower end of the passive member, and the engaging teeth engaging with the driving motor via the engaging gear in the integration and the driving teeth of the passive member engage a transmission gear coupled to a first shaft.

2. The driving mechanism for a massage chair as claimed in claim 1, wherein the primary frame further comprises two sliding tracks, one on each side of the primary frame, two corresponding sides of the massaging set engage with the sliding tracks of the primary frame such that the massaging set is limited to the primary frame and capable of sliding movements.

3. The driving mechanism for a massage chair as claimed in claim 1, wherein the massaging set further comprises two massaging arms, the two massaging arms are symmetrically driven by the first driving shaft and two swing arms.

4. The driving mechanism for a massage chair as claimed in claim 3, wherein the driving motor passes through the integration space to engage with a second driving shaft connected to the swing arms such that the first driving shaft is also able to drive the two massaging arms of the massaging set.

* * * * *